US008385796B2

(12) United States Patent
Naitoh

(10) Patent No.: US 8,385,796 B2
(45) Date of Patent: Feb. 26, 2013

(54) FIXING DEVICE AND IMAGE FORMING APPARATUS INCORPORATING SAME

(75) Inventor: Yutaka Naitoh, Itami (JP)

(73) Assignee: Ricoh Company, Ltd., Tokyo (JP)

( * ) Notice: Subject to any disclaimer, the term of this patent is extended or adjusted under 35 U.S.C. 154(b) by 401 days.

(21) Appl. No.: 12/659,513

(22) Filed: Mar. 11, 2010

(65) Prior Publication Data

US 2010/0232848 A1 Sep. 16, 2010

(30) Foreign Application Priority Data

Mar. 16, 2009 (JP) ..... 2009-063451

(51) Int. Cl.
*G03G 15/20* (2006.01)
*B65H 7/02* (2006.01)

(52) U.S. Cl. ..... 399/322; 399/68; 399/122; 399/406; 271/110

(58) Field of Classification Search ..... 399/67, 399/68, 122, 320, 322, 323, 406; 219/216; 271/110
See application file for complete search history.

(56) References Cited

U.S. PATENT DOCUMENTS

| | | | | |
|---|---|---|---|---|
| 5,448,347 | A * | 9/1995 | Mills | 399/323 |
| 5,594,540 | A * | 1/1997 | Higaya et al. | 399/326 |
| 2004/0217543 | A1 * | 11/2004 | Fukatsu et al. | 271/207 |
| 2008/0056783 | A1 | 3/2008 | Yamamoto et al. | |
| 2008/0193162 | A1 | 8/2008 | Yamazoe et al. | |
| 2009/0022531 | A1 | 1/2009 | Kubota et al. | |
| 2009/0060572 | A1 | 3/2009 | Naitoh et al. | |
| 2009/0074440 | A1 | 3/2009 | Nanno et al. | |
| 2009/0154973 | A1 | 6/2009 | Shimizu et al. | |
| 2009/0162101 | A1 | 6/2009 | Yoshida et al. | |
| 2009/0162772 | A1 | 6/2009 | Fuwa et al. | |
| 2010/0034548 | A1 | 2/2010 | Naitoh et al. | |

FOREIGN PATENT DOCUMENTS

| | | |
|---|---|---|
| JP | 04-125583 | 4/1992 |
| JP | 07-140831 | 6/1995 |
| JP | 2004-067329 | 3/2004 |
| JP | 2005-024645 | 1/2005 |

* cited by examiner

*Primary Examiner* — Walter L Lindsay, Jr.
*Assistant Examiner* — Jessica L Eley
(74) *Attorney, Agent, or Firm* — Harness, Dickey & Pierce, P.L.C.

(57) ABSTRACT

In a fixing device, at least one separator is provided downstream from a fixing nip formed between a fixing rotary member and a pressing rotary member in a recording medium conveyance direction to contact the fixing rotary member to separate a recording medium having passed through the fixing nip from the fixing rotary member. A feeler is provided upstream from the fixing nip in the recording medium conveyance direction and contacted by the recording medium conveyed toward the fixing nip to receive a pushing force from the recording medium. A transmission assembly is connected between the feeler and the separator to receive and transmit the pushing force to the separator to move the separator from a non-contact position at which the separator does not contact the fixing rotary member to a contact position at which the separator contacts the fixing rotary member.

18 Claims, 9 Drawing Sheets

FIXING DEVICE AND IMAGE FORMING APPARATUS INCORPORATING SAME

PRIORITY STATEMENT

The present patent application claims priority from Japanese Patent Application No. 2009-063451, filed on Mar. 16, 2009 in the Japan Patent Office, which is hereby incorporated herein by reference in its entirety.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a fixing rotary member inside which a heat-generating member such as a halogen heater is provided, and a pressing rotary member that presses against the fixing rotary member to form a fixing nip between the fixing rotary member and the pressing rotary member. As a recording medium bearing a toner image passes between the fixing rotary member and the pressing rotary member, the fixing rotary member and the pressing rotary member apply heat and pressure to the recording medium to melt and fix the toner image on the recording medium. Thereafter, the recording medium bearing the fixed toner image is discharged from the fixing nip.

However, it can happen that the recording medium bearing the toner image facing the fixing rotary member gets stuck to the surface of the fixing rotary member due to the adhesive force of the melted toner of the toner image. As a result, the recording medium may not be discharged from the fixing nip properly.

To address this problem, a separator such as a separation pawl may contact the surface of the fixing rotary member in a direction counter to the direction of rotation of the fixing rotary member. Thus, the separator separates the recording medium from the fixing rotary member. However, because the separator remains in constant contact with the fixing rotary member, the surface of the fixing rotary member contacted by the separator experiences wear over time. As a result, the worn fixing rotary member may generate streaks and uneven glosses on the toner image.

To address this problem, the fixing device may further include a separator protection mechanism provided downstream from the fixing nip in the recording medium conveyance direction to separate the separator from the fixing rotary member. When the recording medium lifts the separator protection mechanism, the separator, which is interlocked with the separator protection mechanism via a connecting member, is separated from the fixing rotary member. Accordingly, whenever the recording medium passes between the fixing rotary member and the pressing rotary member and lifts the separator protection mechanism, the separator is separated from the fixing rotary member to suppress wear of the surface of the fixing rotary member due to friction caused by the separator sliding over the fixing rotary member.

However, when the recording medium does not pass between the fixing rotary member and the pressing rotary member, the separator still remains in contact with the fixing rotary member. Moreover, while the fixing device is being driven, a longer time is used to warm up the fixing device or to idle the fixing rotary member than to feed the recording medium between the fixing rotary member and the pressing rotary member. Thus, the separator configured to separate from the fixing rotary member only when the recording medium passes between the fixing rotary member and the pressing rotary member may not be effective to reducing wear of the surface of the fixing rotary member.

Alternatively, the fixing device may include a sensor for detecting the recording medium passing between the fixing rotary member and the pressing rotary member, and a solenoid for separating the separator from the fixing rotary member according to a detection signal provided by the sensor. With this structure, the separator contacts the fixing rotary member only when the recording medium passes between the fixing rotary member and the pressing rotary member. Accordingly, the separator remains separated from the fixing rotary member for a longer time compared to the structure in which the separator separates from the fixing rotary member only when the recording medium passes between the fixing rotary member and the pressing rotary member, thus decreasing wear of the fixing rotary member. However, with such a configuration an electromagnetic transmission device such as a solenoid is needed, resulting in both a larger fixing device and increased manufacturing costs.

SUMMARY

At least one embodiment may provide a fixing device that includes a fixing rotary member, a pressing rotary member, at least one first separator, a feeler, and a transmission assembly. The pressing rotary member contacts the fixing rotary member to form a fixing nip between the fixing rotary member and the pressing rotary member through which a recording medium bearing a toner image passes. The at least one first separator is provided downstream from the fixing nip in a recording medium conveyance direction to contact the fixing rotary member to separate the recording medium having passed between the fixing rotary member and the pressing rotary member from the fixing rotary member. The feeler is provided upstream from the fixing nip in the recording medium conveyance direction and contacted by a leading edge of the recording medium conveyed on a conveyance path toward the fixing nip to receive a pushing force from the recording medium. The transmission assembly is connected between the feeler and the separator to receive and transmit the pushing force received by the feeler from the recording medium to the separator to move the separator from an at-rest non-contact position at which the separator does not contact the fixing rotary member to an in-operation contact position at which the separator contacts the fixing rotary member.

At least one embodiment may provide an image forming apparatus for forming a toner image on a recording medium that includes a fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
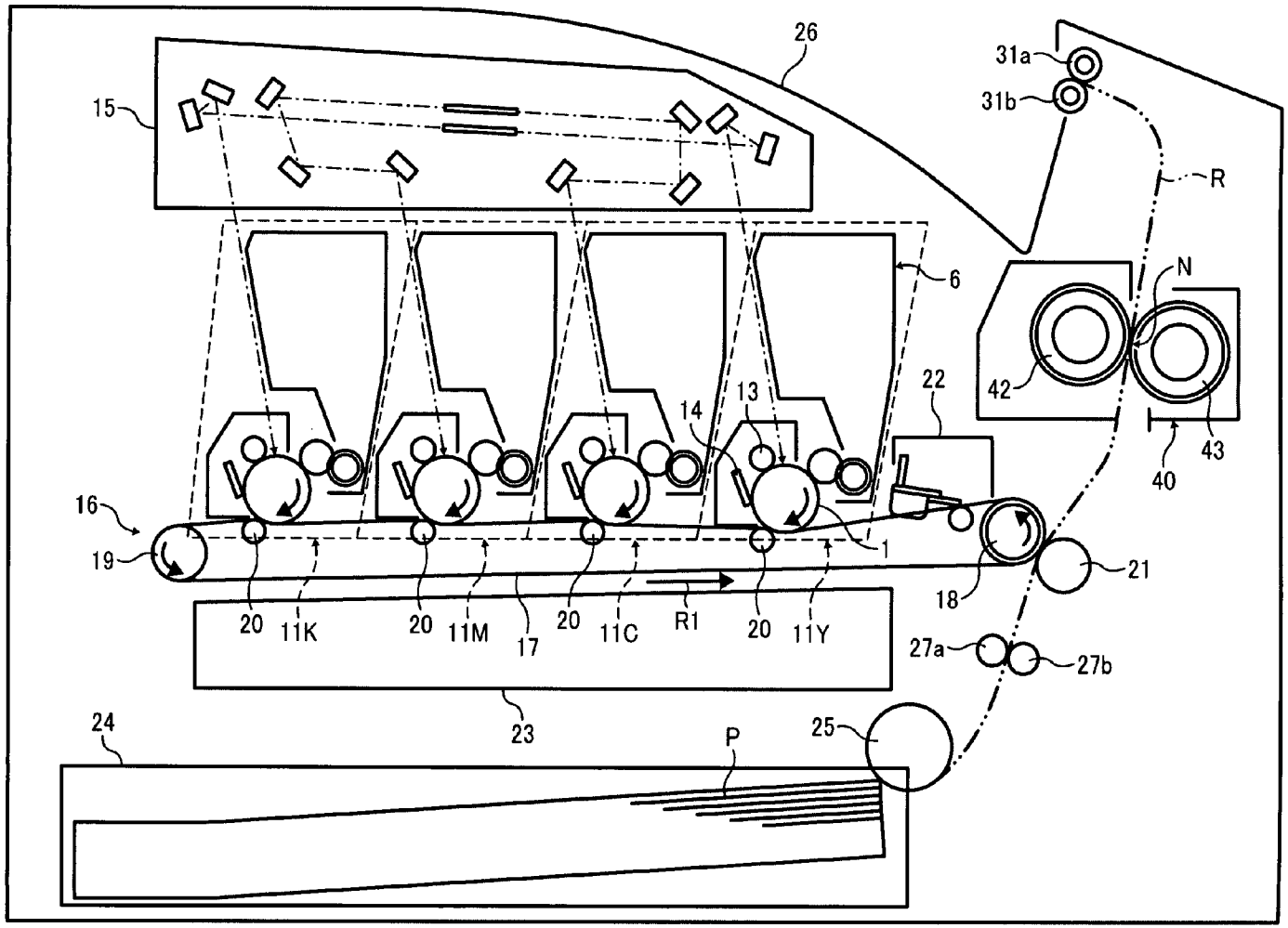
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 12 according to an example embodiment is explained.

FIG. 1 is a schematic view of the image forming apparatus 12. As illustrated in FIG. 1, the image forming apparatus 12 includes process units 11Y, 11C, 11M, and 11K, an exposure device 15, an intermediate transfer unit 16, a second transfer roller 21, a belt cleaner 22, a waste toner container 23, a recording media container 24, a feed roller 25, a stock portion 26, registration rollers 27*a* and 27*b*, output rollers 31*a* and 31*b*, a fixing device 40, and a conveyance path R.

The process unit 11Y includes a photoconductor 1, a development device 6, a charging roller 13, and a cleaning blade 14. The intermediate transfer unit 16 includes an intermediate transfer belt 17, a driving roller 18, a driven roller 19, and first transfer rollers 20. The fixing device 40 includes a fixing roller 42 and a pressing roller 43.

As illustrated in FIG. 1, the image forming apparatus 12 may be a copier, a facsimile machine, a printer, a multifunction printer having at least one of copying, printing, scanning, plotter, and facsimile functions, or the like. The image forming apparatus 12 may form a color image and/or a monochrome image by electrophotography. According to this example embodiment, the image forming apparatus 12 functions as a copier for forming a color image on a recording medium by electrophotography.

The four process units 11Y, 11C, 11M, and 11K are detachably attached to the image forming apparatus 12. The process units 11Y, 11C, 11M, and 11K contain and use toners in different colors (e.g., yellow, cyan, magenta, and black colors corresponding to color separation components of a color image), respectively, but have a similar structure. Accordingly, the following describes the structure of the process unit 11Y which is equivalent to the structure of the process units 11C, 11M, and 11K.

In the process unit 11Y, the photoconductor 1 serves as an image carrier. The charging roller 13 serves as a charger for charging a surface of the photoconductor 1. The development device 6 serves as a development device for supplying a developer (e.g., toner) to the surface of the photoconductor 1. The cleaning blade 14 serves as a cleaner for cleaning the surface of the photoconductor 1.

The exposure device 15 is provided above the process units 11Y, 11C, 11M, and 11K, and exposes the charged surfaces of the photoconductors 1. The intermediate transfer unit 16 is provided below the process units 11Y, 11C, 11M, and 11K. In the intermediate transfer unit 16, the intermediate transfer belt 17 serving as an endless belt is stretched over the driving roller 18 and the driven roller 19, and moves and rotates in a rotation direction R1.

The four first transfer rollers 20, serving as first transfer members, oppose the photoconductors 1 of the process units 11Y, 11C, 11M, and 11K, respectively. The first transfer rollers 20 are pressed against the photoconductors 1 via the intermediate transfer belt 17 to form first transfer nips between the photoconductors 1 and the intermediate transfer belt 17, respectively. The second transfer roller 21, serving as a second transfer member, opposes the driving roller 18. The second transfer roller 21 is pressed against the driving roller 18 via the intermediate transfer belt 17 to form a second transfer nip between the second transfer roller 21 and the intermediate transfer belt 17.

The belt cleaner 22 faces an outer circumferential surface of the intermediate transfer belt 17. A waste toner conveyance hose extending from the belt cleaner 22 is connected to an inlet of the waste toner container 23 provided below the intermediate transfer unit 16 to connect the belt cleaner 22 to the waste toner container 23.

The recording media container 24 and the feed roller 25 are provided in a lower portion of the image forming apparatus 12. The recording media container 24 contains recording media P, such as paper and OHP transparencies. The feed roller 25 feeds the recording media P one by one from the recording media container 24. A recording medium P fed from the recording media container 24 is conveyed toward the stock portion 26 provided on top of the image forming apparatus 12 through the conveyance path R provided inside the image forming apparatus 12. A pair of registration rollers 27*a* and 27*b* is provided between the feed roller 25 and the second transfer roller 21 in the conveyance path R. The fixing device 40 is provided in the conveyance path R at a position downstream from the second transfer roller 21 in a recording medium conveyance direction, that is, at a position above the second transfer roller 21 in FIG. 1. The fixing device 40 fixes a toner image on a recording medium P. In the fixing device 40, the fixing roller 42 and the pressing roller 43 are pressed against each other to form a fixing nip N between the fixing roller 42 and the pressing roller 43. A pair of output rollers 31*a* and 31*b* is provided at a downstream end of the conveyance path R in the recording medium conveyance direction, and outputs the recording medium P bearing the fixed toner image to an outside of the image forming apparatus 12.

Referring to FIG. 1, the following describes an image forming operation of the image forming apparatus 12. When the image forming apparatus 12 receives a command to start an image forming operation, a driver drives and rotates the photoconductors 1 of the process units 11Y, 11C, 11M, and 11K, respectively, clockwise in FIG. 1. In the process units 11Y, 11C, 11M, and 11K, the charging rollers 13 uniformly charge the surfaces of the photoconductors 1 to have a reference polarity, respectively. The exposure device 15 emits laser beams onto the charged surfaces of the photoconductors 1 to form electrostatic latent images on the surfaces of the photoconductors 1 according to image data corresponding to yellow, cyan, magenta, and black colors generated by separating full-color image data, respectively. The development devices 6 supply yellow, cyan, magenta, and black toners to the electrostatic latent images formed on the photoconductors 1 to make the electrostatic latent images visible as yellow, cyan, magenta, and black toner images, respectively.

A driver drives and rotates the driving roller 18 supporting the intermediate transfer belt 17 counterclockwise in FIG. 1 to move and rotate the intermediate transfer belt 17 in the rotation direction R1. A voltage controlled to have a constant voltage or current of a polarity opposite to a polarity of the toners is applied to the first transfer rollers 20 so as to generate a transfer electric field at the first transfer nips between the first transfer rollers 20 and the photoconductors 1, respectively. The transfer electric field generated at the first transfer nips transfers the yellow, cyan, magenta, and black toner images formed on the photoconductors 1 of the process units 11Y, 11C, 11M, and 11K, respectively, onto the outer circumferential surface of the intermediate transfer belt 17 in such a manner that the yellow, cyan, magenta, and black toner images are superimposed on a same position on the intermediate transfer belt 17 sequentially. Thus, a full-color toner image is formed on the outer circumferential surface of the intermediate transfer belt 17.

The cleaning blades 14 remove residual toners remaining on the surfaces of the photoconductors 1 from the surfaces of the photoconductors 1 after the yellow, cyan, magenta, and black toner images are transferred from the photoconductors 1 onto the intermediate transfer belt 17, respectively. Dischargers discharge the surfaces of the photoconductors 1 to initialize a surface potential of the photoconductors 1 so that the photoconductors 1 are ready for a next image forming operation.

The feed roller 25 rotates and feeds a recording medium P contained in the recording media container 24 toward the registration rollers 27*a* and 27*b* in the conveyance path R. The registration rollers 27*a* and 27*b* feed the recording medium P toward the second transfer nip formed between the second transfer roller 21 and the opposing driving roller 18 via the intermediate transfer belt 17 at a proper time. A transfer voltage having a polarity opposite to the polarity of the toners forming the full-color toner image formed on the intermediate transfer belt 17 is applied to the second transfer roller 21 so as to generate a transfer electric field at the second transfer nip between the second transfer roller 21 and the intermediate transfer belt 17. The transfer electric field generated at the second transfer nip transfers the full-color toner image formed on the intermediate transfer belt 17 onto the recording medium P at a time. The recording medium P bearing the full-color toner image is sent to the fixing device 40. When the recording medium P bearing the full-color toner image passes through the fixing nip N between the fixing roller 42 and the pressing roller 43, the fixing roller 42 and the pressing roller 43 apply heat and pressure to the recording medium P to melt and fix the full-color toner image on the recording medium P. The recording medium P bearing the fixed full-color toner image is sent to the output rollers 31*a* and 31*b* so that the output rollers 31*a* and 31*b* output the recording medium P onto the stock portion 26. The belt cleaner 22 removes residual toner remaining on the intermediate transfer belt 17 from the intermediate transfer belt 17 after the full-color toner image is transferred onto the recording medium P. The removed toner is sent and collected into the waste toner container 23.

The above-described image forming operation forms the full-color toner image on the recording medium P. Alternatively, the image forming apparatus 12 may form a monochrome toner image by using one of the four process units 11Y, 11C, 11M, and 11K, or may form a two-color toner image or a three-color toner image by using two or three of the four process units 11Y, 11C, 11M, and 11K.

Referring to FIGS. 2 to 8, the following describes a structure of the fixing device 40.

Figure 2:
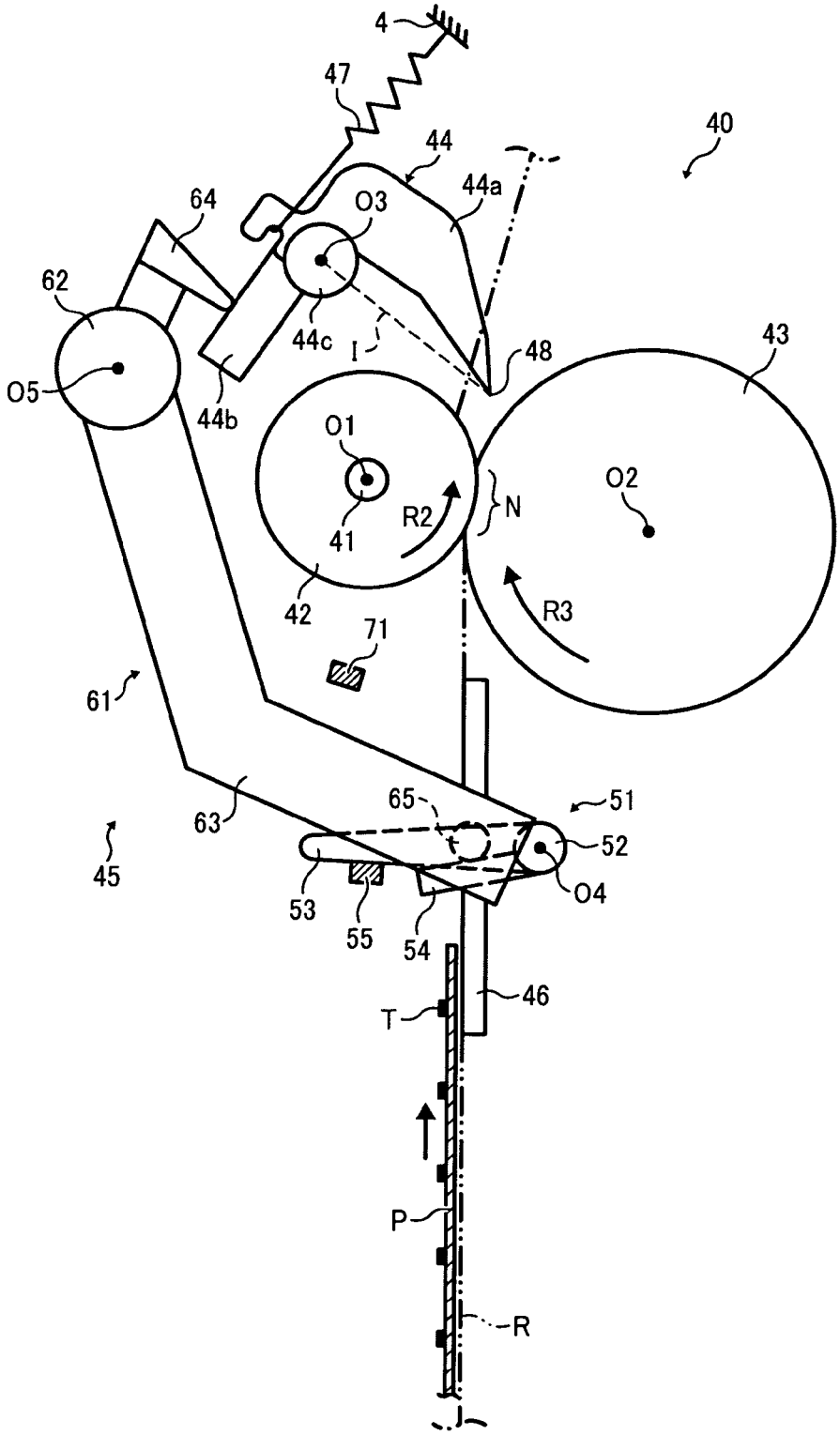
FIG. 2 is a partially sectional view (according to an example embodiment) of a fixing device included in the image forming apparatus shown in FIG. 1 when a separator included in the fixing device is at a non-contact position.

FIG. 2 is a partially sectional view of the fixing device 40. As illustrated in FIG. 2, the fixing device 40 further includes a frame 4, a heat source 41, a separator 44, a control mechanism 45, an entrance guide 46, a biasing member 47, and a restriction member 71.

The separator 44 includes a body 44*a*, a pressure reception portion 44*b*, and a rotary shaft 44*c*. The body 44*a* includes a front edge portion 48. The control mechanism 45 includes a feeler 51 and a transmission assembly 61. The feeler 51 includes a rotary shaft 52, a contact portion 53, a pressing portion 54, and a stopper 55. The transmission assembly 61 includes a rotary shaft 62, a feeler contact portion 63, a separator contact portion 64, and a contact pin 65.

Figure 3:
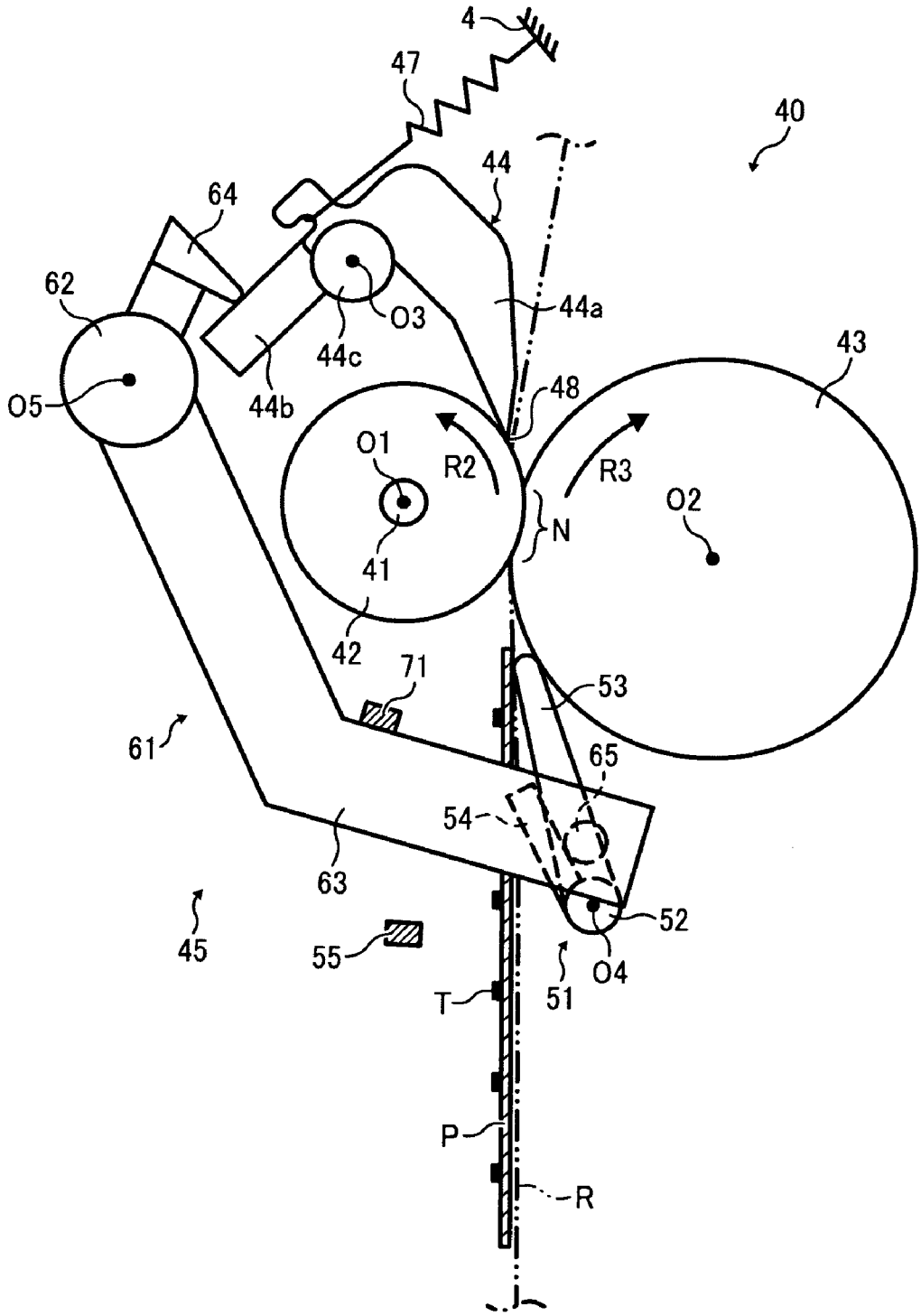
FIG. 3 is a partially sectional view (according to an example embodiment) of the fixing device shown in FIG. 2 when the separator is at a contact position.

FIG. 3 is a partially sectional view of the fixing device 40.

Figure 4:
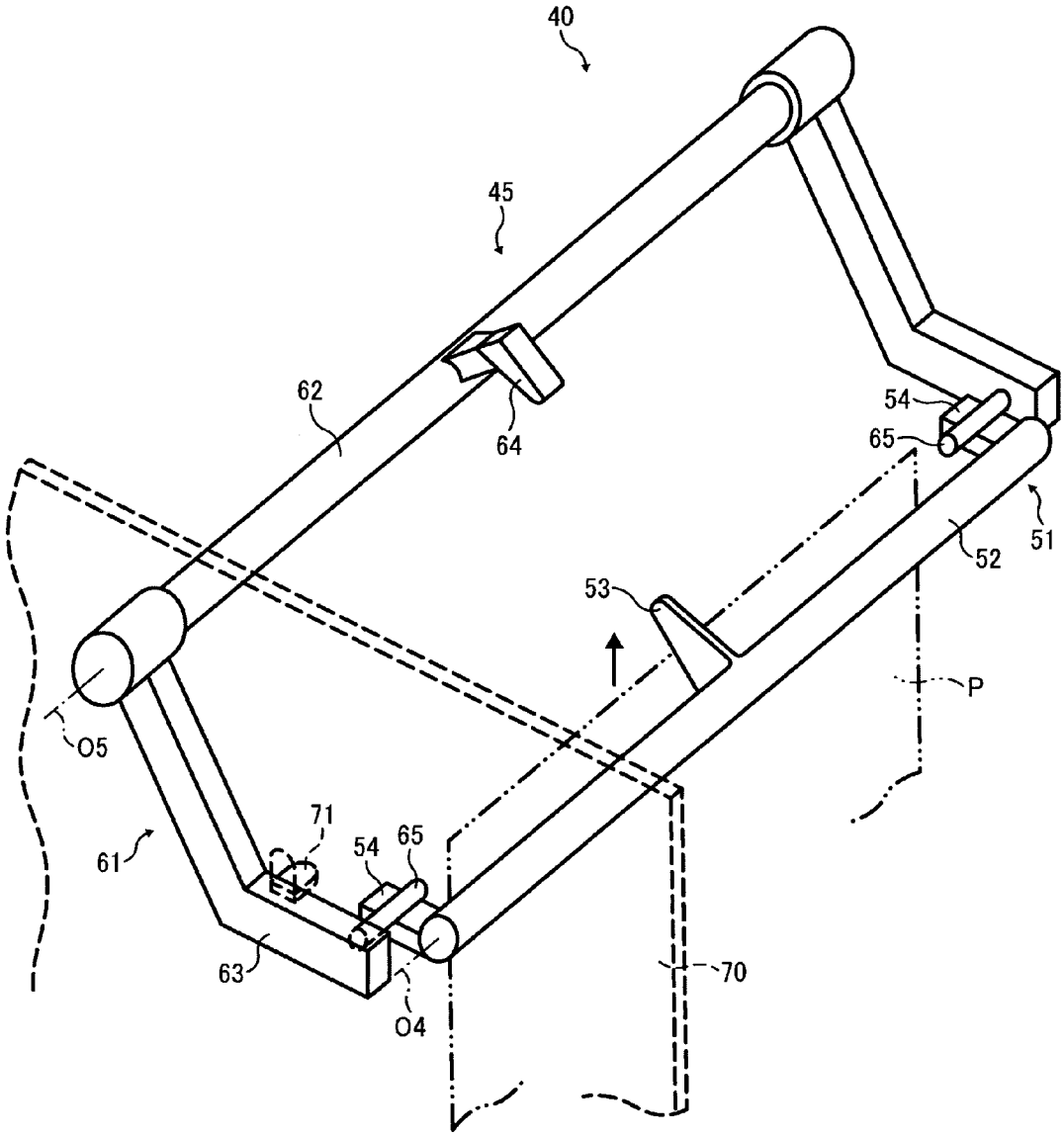
FIG. 4 is a perspective view (according to an example embodiment) of a control mechanism included in the fixing device shown in FIG. 2.

FIG. 4 is a perspective view of the control mechanism 45. As illustrated in FIG. 4, the fixing device 40 further includes a side plate 70.

Figure 5A:
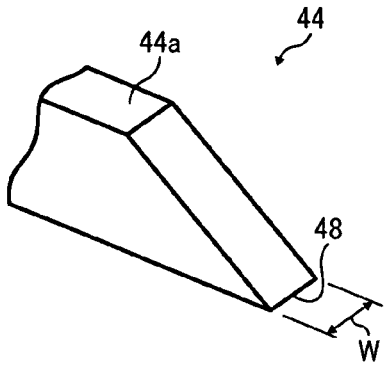
FIG. 5A is a perspective view (according to an example embodiment) of the separator shown in FIG. 2.

FIG. 5A is a perspective view of the separator 44.

Figure 5B:
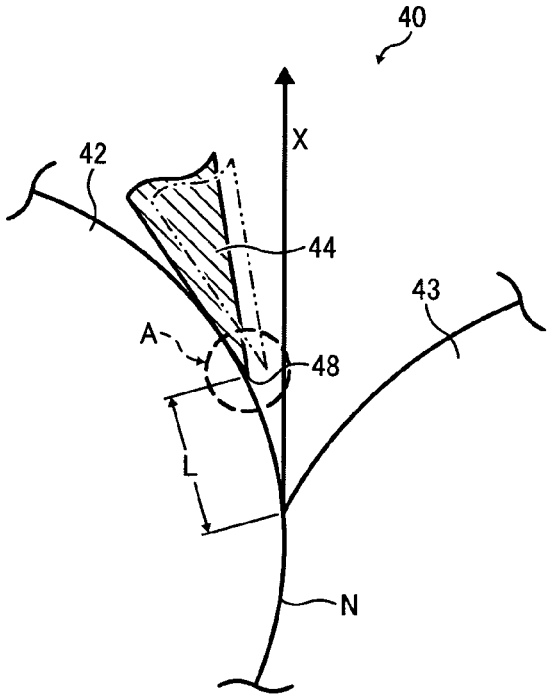
FIG. 5B is an axial end view (according to an example embodiment) of the fixing device shown in FIG. 2 for illustrating the separator contacting a fixing roller included in the fixing device.

FIG. 5B is an axial end view of the fixing device 40 for illustrating the separator 44 contacting the fixing roller 42.

Figure 5C:
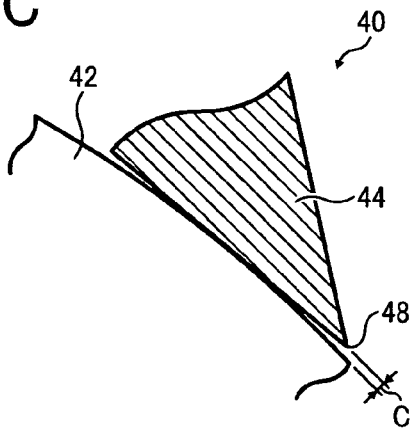
FIG. 5C is an enlarged view (according to an example embodiment) of the separator shown in FIG. 5B contacting the fixing roller shown in FIG. 5B.

FIG. 5C is an enlarged view of the separator 44 contacting the fixing roller 42.

Figure 6:
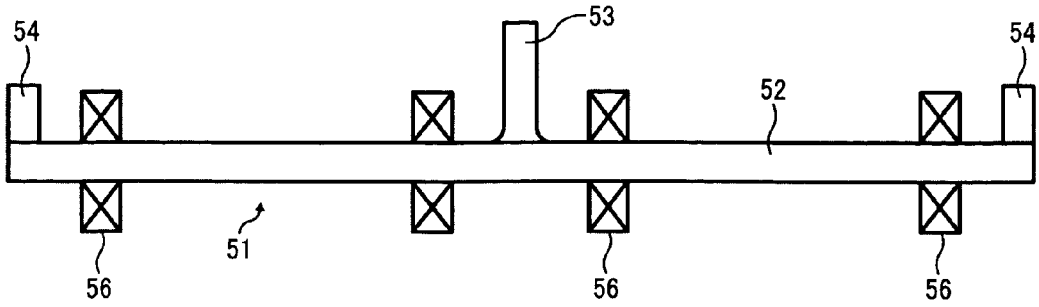
FIG. 6 is a plane view (according to an example embodiment) of a feeler included in the fixing device shown in FIG. 2.

FIG. 6 is a plane view of the feeler 51. As illustrated in FIG. 6, the feeler 51 further includes bearings 56.

Figure 7:
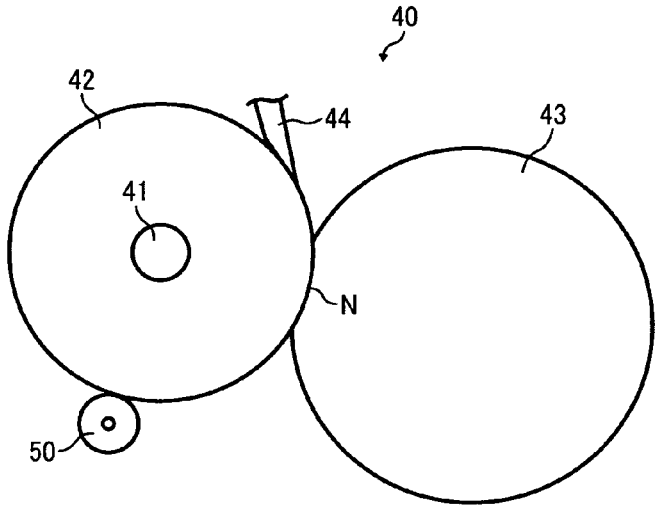
FIG. 7 is an axial end view (according to an example embodiment) of the fixing device shown in FIG. 2 for illustrating a cleaning roller included in the fixing device.

FIG. 7 is an axial end view of the fixing device 40. As illustrated in FIG. 7, the fixing device 40 further includes a cleaning roller 50.

Figure 8:
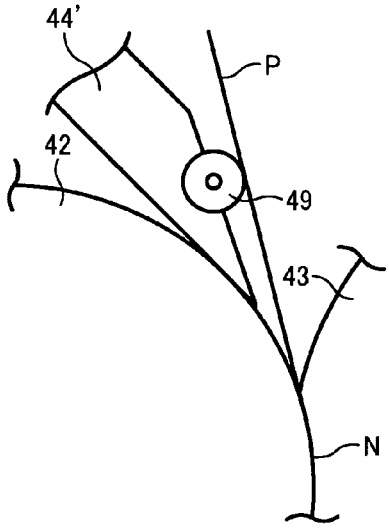
FIG. 8 is an axial end view (according to an example embodiment) of an example variation of the separator shown in FIG. 2.

FIG. 8 is an axial end view of a separator 44' as an example variation of the separator 44 depicted in FIG. 2. As illustrated in FIG. 8, the separator 44' includes an exit guide 49.

As illustrated in FIG. 2, the heat source 41 heats the fixing roller 42 serving as a fixing rotary member rotating in a rotation direction R2. The pressing roller 43, serving as a pressing rotary member, is pressed against the fixing roller 42 by a pressing mechanism, and is rotated in a rotation direction R3. The separator 44 (e.g., a separation pawl) contacts and separates from an outer circumferential surface of the fixing roller 42. The control mechanism 45 controls movement of the separator 44 to adjust a position of the separator 44. A contact portion at which the fixing roller 42 contacts the pressing roller 43 serves as the fixing nip N through which a recording medium P bearing a toner image T, which is guided by the entrance guide 46, passes.

The fixing roller 42 has a cylindrical shape and is rotated about a rotation axis O1. The fixing roller 42 includes a base having thermal conductivity, an elastic layer provided around the base, and a covering layer covering the elastic layer. For example, the base has a desired mechanical strength, and includes a material having proper thermal conductivity such as aluminum. Alternatively, the base may include carbon steel and/or heat-resistant glass. The elastic layer includes synthetic rubber such as silicon rubber and/or fluorocarbon rubber. The covering layer, which is provided on an outer side or an outer circumferential surface of the elastic layer, includes a material having high thermal conductivity and high heat resistance to provide improved releasing property for releasing toner from the fixing roller 42 and improved durability of the elastic layer. For example, the covering layer may be a tube including fluorocarbon resin such as PFA (tetrafluoroethylene-perfluoroalkyl vinyl ether copolymer), a coating layer coated with fluorocarbon resin such as PFA or PTFE (polytetrafluoroethylene), a silicon rubber layer, or a fluorocarbon rubber layer.

A temperature sensor serving as a temperature detector and/or a thermostat for preventing abnormal temperature faces the outer circumferential surface of the fixing roller 42. A surface temperature of the fixing roller 42 is controlled within a desired temperature range based on a detection signal provided by the temperature sensor. As illustrated in FIG. 7, the cleaning roller 50 may contact the outer circumferential surface of the fixing roller 42 to reduce pawl marks generated on the fixing roller 42 by the separator 44.

As illustrated in FIG. 2, the pressing roller 43 has a cylindrical shape and is rotated about a rotation axis O2. The pressing roller 43 includes a core metal, an elastic layer provided on an outer side or an outer circumferential surface of the core metal, and a covering layer covering the elastic layer.

For example, the core metal includes an STKM pipe. The elastic layer includes silicon rubber, fluorocarbon rubber, silicon rubber foam, and/or fluorocarbon rubber foam. The covering layer includes a heat-resistant fluorocarbon resin tube including PFA and/or PTFA providing improved releasing property for releasing toner from the pressing roller 43.

At the fixing nip N, a recording medium P receives pressure and a given amount of heat from the heat source 41 provided inside the fixing roller 42 so that a toner image T is heated and fixed on the recording medium P by the heat and the pressure applied at the fixing nip N. The front edge portion 48 of the separator 44 contacts the outer circumferential surface of the fixing roller 42 as illustrated in FIG. 3 to separate the recording medium P adhered to the outer circumferential surface of the fixing roller 42 by an adhesive force of melted toner of the toner image T from the outer circumferential surface of the fixing roller 42.

As illustrated in FIG. 2, in the separator 44, the body 44*a* and the pressure reception portion 44*b* are mounted on the rotary shaft 44*c*. In other words, the rotary shaft 44*c* rotatably supports the separator 44 in such a manner that the separator 44 is rotated about a rotation axis O3 of the rotary shaft 44*c* parallel to the rotation axis O1 of the fixing roller 42. The pressure reception portion 44*b* extends from the body 44*a* in a direction substantially perpendicular to a line I connecting the rotation axis O3 of the rotary shaft 44*c* of the separator 44 to the front edge portion 48 of the body 44*a* of the separator 44. In other words, the pressure reception portion 44*b* extends from the body 44*a* in a direction intersecting the line I connecting the rotation axis O3 of the separator 44 to a contact portion of the separator 44 for contacting the fixing roller 42, that is, the front edge portion 48 of the separator 44. The body 44*a* is provided in a side of the separator 44 facing the conveyance path R, that is, the right side of the rotation axis O3 in FIG. 2. By contrast, the pressure reception portion 44*b* is provided in a side of the separator 44 opposite to the side in which the body 44*a* is provided, that is, the left side of the rotation axis O3 in FIG. 2. The biasing member 47 (e.g., a tension spring) is provided between the body 44*a* and the frame 4 serving as a stationary member. The biasing member 47 applies a biasing force to the body 44*a* of the separator 44 to cause the body 44*a* to press the front edge portion 48 toward the fixing roller 42 constantly.

In the separator 44, at least the body 44*a* includes a material providing desired releasing property and sliding property such as PFA, PEK (polyetherketone), and/or PEEK (polyetheretherketone). Alternatively, a material providing desired releasing property and sliding property such as PFA or Teflon® may be coated on the separator 44 as a surface layer. The pressure reception portion 44*b* may include a material equivalent to the material of the body 44*a* or other material.

As illustrated in FIG. 5A, a width W of the body 44*a* is not smaller than about 2 mm. When the width W of the body 44*a* is smaller than about 2 mm, strength of the body 44*a* decreases. For example, the body 44*a* may be deformed or damaged when the recording medium P is jammed, and the deformed or damaged body 44*a* may damage the fixing roller 42 and the pressing roller 43 depicted in FIG. 2.

An arbitrary number of separators 44 may be provided in the fixing device 40. For example, one separator 44 may be provided near a center portion of the fixing roller 42 in an axial direction of the fixing roller 42. Alternatively, a plurality of separators 44 may be provided at a plurality of positions in the axial direction of the fixing roller 42 according to sizes of recording media P used in the image forming apparatus 12 depicted in FIG. 1.

FIG. 8 illustrates the separator 44' as an example variation of the separator 44 depicted in FIG. 2. The exit guide 49 (e.g., a roller) is provided on a slide surface of the separator 44' over which the recording medium P slides. The exit guide 49 guides and discharges the recording medium P stably from the fixing nip N.

As illustrated in FIG. 5B, when the separator 44 contacts the fixing roller 42, a distance L in a range from about 4 mm to about 5 mm may be provided between the front edge portion 48 of the separator 44 and an exit of the fixing nip N in the recording medium conveyance direction. When the distance L is smaller than the above-described range, the recording medium P slides over a back surface of the body 44*a* depicted in FIG. 2, generating noise. By contrast, when the distance L is greater than the above-described range, the recording medium P adheres to the fixing roller 42 for a longer time, resulting in hot offset of the toner image T and curling of the recording medium P.

As illustrated in FIG. 5C, when the separator 44 contacts the fixing roller 42, a clearance C smaller than about 0.1 mm is provided between the front edge portion 48 of the separator 44 and the outer circumferential surface of the fixing roller 42 in a direction substantially perpendicular to the recording medium conveyance direction. When the clearance C is greater than the above-described range, the separator 44 may not separate a recording medium P having a low rigidity (e.g., thin paper or paper having a high percentage of moisture content) from the fixing roller 42 properly. By contrast, when the clearance C is smaller than the above-described range, a jammed recording medium P may damage the fixing roller 42 and the pressing roller 43 depicted in FIG. 2.

As illustrated in FIG. 5B, either when the separator 44 contacts the outer circumferential surface of the fixing roller 42 or when the separator 44 separates from the fixing roller 42, the separator 44 is provided in a second compartment provided with the fixing roller 42, which is on the left of a tangent line X tangent to a curve of the outer circumferential surface of the fixing roller 42 at the exit of the fixing nip N. Accordingly, even when the recording medium P passes through the fixing nip N while the separator 44 separates from the fixing roller 42 due to some reason, the separator 44 may not interfere with movement of the recording medium P discharged from the fixing nip N, and therefore may not jam the recording medium P.

As illustrated in FIG. 4, the control mechanism 45 includes the feeler 51 serving as an input mechanism and the transmission assembly 61.

In the feeler 51, the contact portion 53 is provided on a center portion of the rotary shaft 52 in an axial direction of the rotary shaft 52, and protrudes in a radial direction of the rotary shaft 52. The pressing portions 54 are provided on both ends of the rotary shaft 52 in the axial direction of the rotary shaft 52, respectively, and protrude in the radial direction of the rotary shaft 52. A length of the rotary shaft 52 is greater than a length (e.g., a width) of the recording medium P in the axial direction of the rotary shaft 52, and therefore, both ends of the rotary shaft 52 in the axial direction of the rotary shaft 52 protrude beyond both side edges of the recording medium P, respectively, in the axial direction of the rotary shaft 52. The contact portion 53 and the pressing portions 54 are rotatable with the rotary shaft 52. The contact portion 53 protrudes to a position at which the contact portion 53 interferes with movement of the recording medium P conveyed on the conveyance path R depicted in FIG. 2 in the radial direction of the rotary shaft 52, and contacts the recording medium P. By contrast, the pressing portions 54 are provided at both ends of the rotary shaft 52 in the axial direction of the rotary shaft 52, respectively, and do not contact the recording medium P conveyed on the conveyance path R.

As illustrated in FIG. 2, the position of the contact portion 53 is shifted slightly from the position of the pressing portions 54 in a circumferential direction of the feeler 51. Accordingly, when the feeler 51 is at a standby position (e.g., a non-contact position at which the feeler 51 does not contact the recording medium P) as illustrated in FIG. 2, the contact portion 53 is disposed closer to the fixing nip N than the pressing portions 54 are.

As illustrated in FIGS. 2 and 3, the feeler 51 is supported in such a manner that the feeler 51 is rotatable forward and backward about a rotation axis O4 of the rotary shaft 52 which is parallel to the rotation axis O1 of the fixing roller 42. The rotation axis O4 of the feeler 51 is provided in a first compartment defined by the conveyance path R and the pressing roller 43, which is on the right of the conveyance path R. The feeler 51 rotates forward and backward between the standby position illustrated in FIG. 2 at which the contact portion 53 is ready to contact a leading edge of the recording medium P and a retreat position illustrated in FIG. 3 at which the contact portion 53 retreats from the conveyance path R. As illustrated in FIG. 2, the stopper 55 contacts the contact portion 53 to restrict counterclockwise rotation of the feeler 51 from the standby position. In FIG. 3, the entrance guide 46 depicted in FIG. 2 is omitted to simplify the drawing.

As illustrated in FIG. 6, a plurality of bearings 56, for example, four bearings 56, rotatably supports the rotary shaft 52 of the feeler 51. The bearings 56 may be slide bearings or roller bearings. A number of the bearings 56 may be increased to prevent the rotary shaft 52 from bending. However, when the number of the bearings 56 is increased excessively, friction between the bearings 56 and the rotary shaft 52 may increase and prevent smooth rotation of the feeler 51. To address this problem, the number of the bearings 56 is adjusted according to size and requested performance of the image forming apparatus 12 depicted in FIG. 1.

As illustrated in FIG. 4, in the transmission assembly 61, the feeler contact portions 63 are provided on both ends of the rotary shaft 62 in an axial direction of the rotary shaft 62, and protrude from both ends of the rotary shaft 62 in a radial direction of the rotary shaft 62, respectively. The separator contact portion 64 is provided on a center portion of the rotary shaft 62 in the axial direction of the rotary shaft 62, and protrudes from the center portion of the rotary shaft 62 in the radial direction of the rotary shaft 62. The feeler contact portions 63 and the separator contact portion 64 are rotatable with the rotary shaft 62. The feeler contact portions 63 extend close to both ends of the rotary shaft 52 of the feeler 51 in the axial direction of the rotary shaft 52 in such a manner that the feeler contact portions 63 sandwich the feeler 51 in the axial direction of the rotary shaft 52. As illustrated in FIG. 2, the separator contact portion 64 of the transmission assembly 61 extends to a position at which the separator contact portion 64 contacts the pressure reception portion 44*b* of the separator 44.

A rotation axis O5 of the rotary shaft 62 of the transmission assembly 61 is parallel to the rotation axis O1 of the fixing roller 42. The rotary shaft 62 of the transmission assembly 61 is provided in the second compartment defined by the conveyance path R and the fixing roller 42, which is on the left of the conveyance path R for conveying the recording medium P.

Like the rotary shaft 52 of the feeler 51 illustrated in FIG. 6, the rotary shaft 62 of the transmission assembly 61 is rotatably supported by a plurality of bearings. Accordingly, the transmission assembly 61 swings forward and backward about the rotation axis O5 of the rotary shaft 62.

As illustrated in FIG. 4, the contact pins 65 are mounted on inner surfaces of front edge portions of the feeler contact portions 63, respectively. The contact pins 65 are provided above the pressing portions 54 of the feeler 51 as illustrated in FIG. 2, and contact upper surfaces of the pressing portions 54, respectively. In other words, the contact pins 65 are disposed closer to the fixing nip N than the pressing portions 54 are, and contact the upper surfaces of the pressing portions 54, respectively.

As illustrated in FIG. 2, centers of gravity of the feeler contact portions 63 and the separator contact portion 64 of the transmission assembly 61 are disposed in the second compartment provided between the rotation axis O5 of the rotary shaft 62 and the conveyance path R in a direction perpendicular to the recording medium conveyance direction, which is on the right of the rotation axis O5 of the rotary shaft 62. Therefore, a center of gravity G of the entire transmission assembly 61 is disposed in the second compartment between the rotation axis O5 of the rotary shaft 62 and the conveyance path R, which is on the right of the rotation axis O5 of the rotary shaft 62. Accordingly, the transmission assembly 61 is constantly applied with a biasing force by the gravity thereof to rotate clockwise in FIG. 2. The biasing force for rotating the transmission assembly 61 clockwise is transmitted to the body 44*a* of the separator 44 via the separator contact portion 64 of the transmission assembly 61 and the pressure reception portion 44*b* of the separator 44. Consequently, the body 44*a* rotates counterclockwise in FIG. 2 against a biasing force applied by the biasing member 47. As a result, the front edge portion 48 of the separator 44 separates from the outer circumferential surface of the fixing roller 42. The biasing force (e.g., an elastic force) applied by the biasing member 47 is determined to maintain the front edge portion 48 of the separator 44 to be separated from the outer circumferential surface of the fixing roller 42.

The following describes operations of the fixing device 40.

As illustrated in FIG. 2, before a recording medium P contacts the feeler 51, the feeler 51 is at the standby position. Accordingly, a weight of the transmission assembly 61 applies a biasing force to the transmission assembly 61 in a clockwise direction, so that the pressing portions 54 of the feeler 51 contact the contact pins 65 of the transmission assembly 61 and the separator contact portion 64 of the transmission assembly 61 contacts the pressure reception portion 44*b* of the separator 44. The biasing force generated by the weight of the transmission assembly 61 applies a pressing force to the separator 44 so that the separator 44 rotates counterclockwise against a biasing force generated by the biasing member 47. Consequently, the front edge portion 48 of the separator 44 separates from the outer circumferential surface of the fixing roller 42.

When the leading edge of the recording medium P conveyed on the conveyance path R contacts the contact portion 53 of the feeler 51, an impact generated by the contact rotates the feeler 51 clockwise. Accordingly, the contact portion 53 retreats from the conveyance path R, and the feeler 51 moves to the retreat position as illustrated in FIG. 3. Thus, the recording medium P is guided by the entrance guide 46 smoothly to the fixing nip N depicted in FIG. 2. A force (e.g., a pushing force) received by the feeler 51 when the leading edge of the recording medium P contacts the feeler 51 is converted into a rotation force of the feeler 51, and is transmitted to the transmission assembly 61 via the pressing portions 54 and the contact pins 65 contacting each other. The contact pins 65 slide over the pressing portions 54.

Thus, the pushing force transmitted from the contact portion 53 of the feeler 51 to the transmission assembly 61 rotates the transmission assembly 61 counterclockwise. Accordingly, the separator contact portion 64 of the transmission assembly 61 moves in a direction in which the separator contact portion 64 separates from the pressure reception portion 44*b* of the separator 44. Thus, the pressing force applied by the separator contact portion 64 to the pressure reception portion 44*b* is released. Accordingly, the biasing force applied by the biasing member 47 to the separator 44 rotates the separator 44 clockwise, and the front edge portion 48 of the separator 44 contacts the outer circumferential surface of the fixing roller 42 as illustrated in FIG. 3. Consequently, the separator 44 separates or peels the recording medium P, which is applied with heat and pressure at the fixing nip N and is adhered to the outer circumferential surface of the fixing roller 42, from the fixing roller 42.

As illustrated in FIG. 3, the restriction member 71 is provided above the feeler contact portion 63 of the transmission assembly 61 and engages the transmission assembly 61 so as to restrict movement of the transmission assembly 61. Thus, the transmission assembly 61 does not further rotate counterclockwise. Accordingly, the separator 44 is pressed against the fixing roller 42 with a constant contact pressure or a constant linear pressure.

As illustrated in FIG. 4, a part of the side plate 70 supporting the fixing roller 42 and the pressing roller 43 depicted in FIG. 3 may be cut and bent into the restriction member 71, for example.

When the recording medium P has passed through the feeler 51 wholly, a weight of the feeler 51 rotates the feeler 51 counterclockwise, and the contact portion 53 contacts the stopper 55. Thus, the feeler 51 returns to the standby position as illustrated in FIG. 2. Accordingly, the weight of the transmission assembly 61 applies the biasing force to the transmission assembly 61 to rotate the transmission assembly 61 clockwise, and the separator contact portion 64 of the transmission assembly 61 presses against the separator 44. Consequently, both the transmission assembly 61 and the separator 44 return to the standby position as illustrated in FIG. 2.

In the fixing device 40 illustrated in FIG. 4, one separator contact portion 64 is provided in the transmission assembly 61. Alternatively, when a plurality of separators 44 is provided in the axial direction of the fixing roller 42, a plurality of separator contact portions 64 corresponding to the number of separators 44 may be mounted on the rotary shaft 62 of the transmission assembly 61. Thus, the plurality of separator contact portions 64 corresponds to the plurality of separators 44 in one-to-one relation.

Referring to FIGS. 2 and 3, the following describes effects provided by the fixing device 40 having the above-described structure.

A pushing force received by the feeler 51 when the leading edge of the recording medium P contacts and pushes the feeler 51 is mechanically transmitted to the separator 44 via the transmission assembly 61 to switch a position of the separator 44 between an in-operation contact position at which the separator 44 contacts the fixing roller 42 as illustrated in FIG. 3 and an at-rest non-contact position at which the separator 44 separates from the fixing roller 42 as illustrated in FIG. 2. Accordingly, the compact fixing device 40 may be manufactured at reduced costs compared to a fixing device using an electromagnetic transmission device such as a sensor and a solenoid. Further, disturbance may not adversely affect control for switching the position of the separator 44, improving stability of the control.

The feeler 51 provided upstream from the fixing nip N in the recording medium conveyance direction detects the recording medium P before the recording medium P reaches the fixing nip N. Movement of the separator 44 may be controlled easily in such a manner that the separator 44 separates from the fixing roller 42 normally and the separator 44 contacts the fixing roller 42 immediately before the recording medium P enters the fixing nip N. Thus, an accumulated separation time when the separator 44 separates from the fixing roller 42 may be increased to suppress wear of the fixing roller 42 and increase life of the fixing roller 42.

The transmission assembly 61 is biased clockwise constantly. Accordingly, the contact pins 65 of the transmission assembly 61 contact the pressing portions 54 of the feeler 51, and the separator contact portion 64 of the transmission assembly 61 contacts the pressure reception portion 44*b* of the separator 44 even when the feeler 51 is at the standby position. Consequently, change of the position of the feeler 51 is transmitted to the separator 44 instantly without time lag. In other words, the position of the separator 44 is switched quickly. Further, the transmission assembly 61 biased clockwise constantly by rotation of the transmission assembly 61 due to the weight of the transmission assembly 61 may reduce a number of parts used in the fixing device 40 and simplify the structure of the fixing device 40.

The pressure reception portion 44*b* extends from the body 44*a* in the direction intersecting the line I connecting the rotation axis O3 of the separator 44 to the contact portion (e.g., the front edge portion 48) of the separator 44 for contacting the fixing roller 42. Accordingly, the separator contact portion 64 of the transmission assembly 61 contacts a surface of the separator 44 (e.g., the body 44*b*) at a substantially right angle. Consequently, a pressing force is transmitted from the separator contact portion 64 to the separator 44 with an improved efficiency to return the separator 44 to the standby position as illustrated in FIG. 2 precisely or maintain the separator 44 at the standby position.

In the fixing device 40 according to this example embodiment, after a recording medium P contacts the feeler 51 initially, the feeler 51 moves and contacts a back side of the recording medium P in the first compartment defined by the conveyance path R and the pressing roller 43, which is on the right of the conveyance path R as illustrated in FIG. 3. Before the recording medium P enters the fixing nip N, the recording medium P bears an unfixed toner image T on a front side of the recording medium P facing the fixing roller 42. If the feeler 51 contacts the unfixed toner image T on the front side of the recording medium P, the feeler 51 may degrade quality of the unfixed toner image T. To address this problem, in the fixing device 40, the feeler 51 contacts the back side of the recording medium P not bearing the unfixed toner image T. When the recording medium P bears toner images on both front and back sides of the recording medium P in a duplex printing mode, the feeler 51 contacts a fixed toner image on the front side of the recording medium P, thus not degrading quality of an unfixed toner image on the back side of the recording medium P.

Referring to FIGS. 9 to 13, the following describes example variations of the fixing device 40 depicted in FIG. 2.

Figure 9:
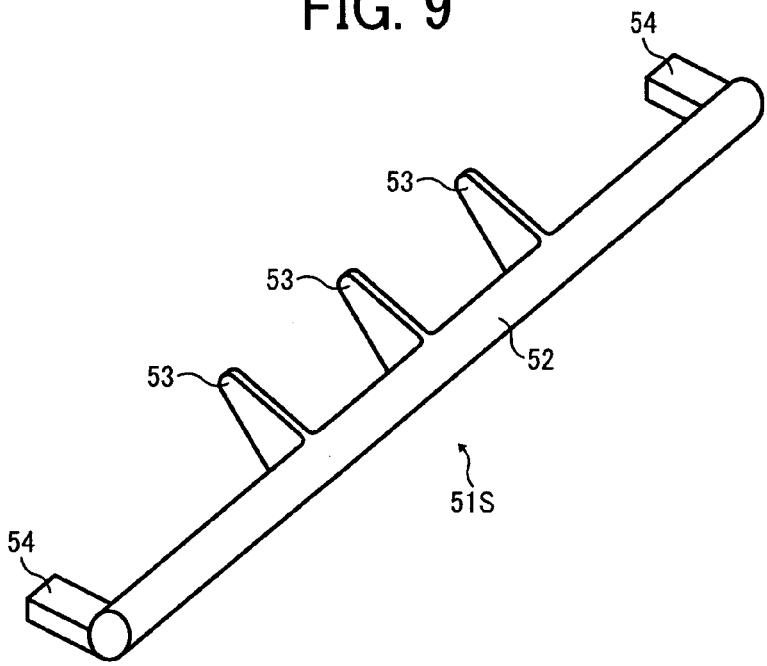
FIG. 9 is a perspective view (according to an example embodiment) of an example variation of the feeler shown in FIG. 6.

FIG. 9 is a perspective view of a feeler 51S. As illustrated in FIG. 9, the feeler 51S includes a plurality of contact portions 53.

The feeler 51 of the fixing device 40 illustrated in FIG. 4 includes one contact portion 53. Alternatively, the feeler 51S, serving as an input mechanism, may include an arbitrary number of contact portions 53. For example, as illustrated in FIG. 9, three contact portions 53 may be mounted on the rotary shaft 52. The plurality of contact portions 53 disperses a load applied to the recording medium P when the recording medium P contacts the plurality of contact portions 53, preventing or reducing creases and damages of the recording medium P such as damages of a cut edge of the recording medium P.

Figure 10:
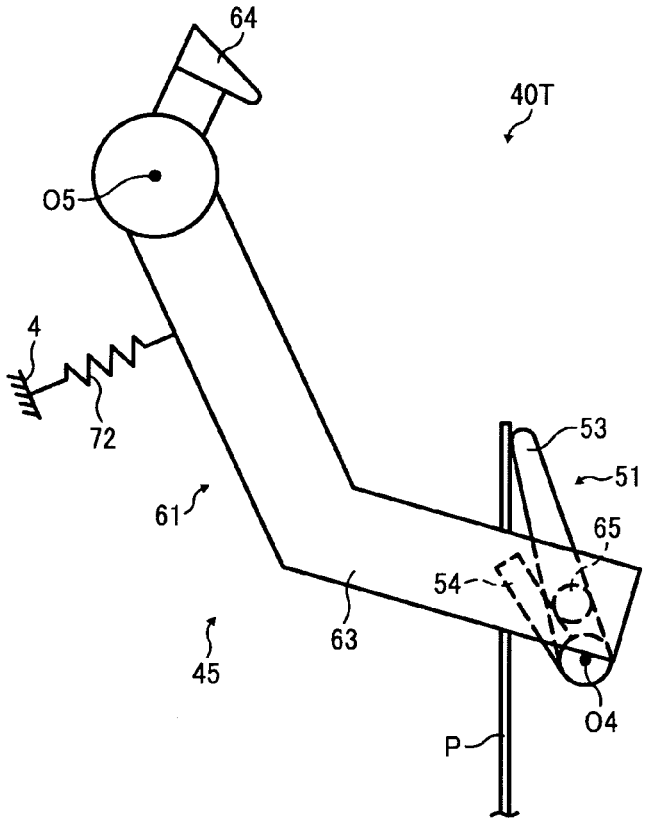
FIG. 10 is an axial end view of a fixing device according to another example embodiment.

Referring to FIG. 10, the following describes a fixing device 40T. FIG. 10 is an axial end view of the fixing device 40T. As illustrated in FIG. 10, the fixing device 40T includes a biasing member 72. The other elements of the fixing device 40T are equivalent to the elements of the fixing device 40 depicted in FIG. 2.

In the fixing device 40 depicted in FIG. 2, the weight of the transmission assembly 61 generates a biasing force to move the transmission assembly 61. By contrast, in the fixing device 40T depicted in FIG. 10, the biasing member 72 applies a biasing force to the transmission assembly 61 to move the transmission assembly 61. The biasing member 72 is provided between the feeler contact portion 63 of the transmission assembly 61 and the frame 4 serving as a stationary member in such a manner that the biasing member 72 is stretched. Alternatively, a biasing member may be provided between the feeler 51 and a stationary member (e.g., the frame 4).

Figure 11:
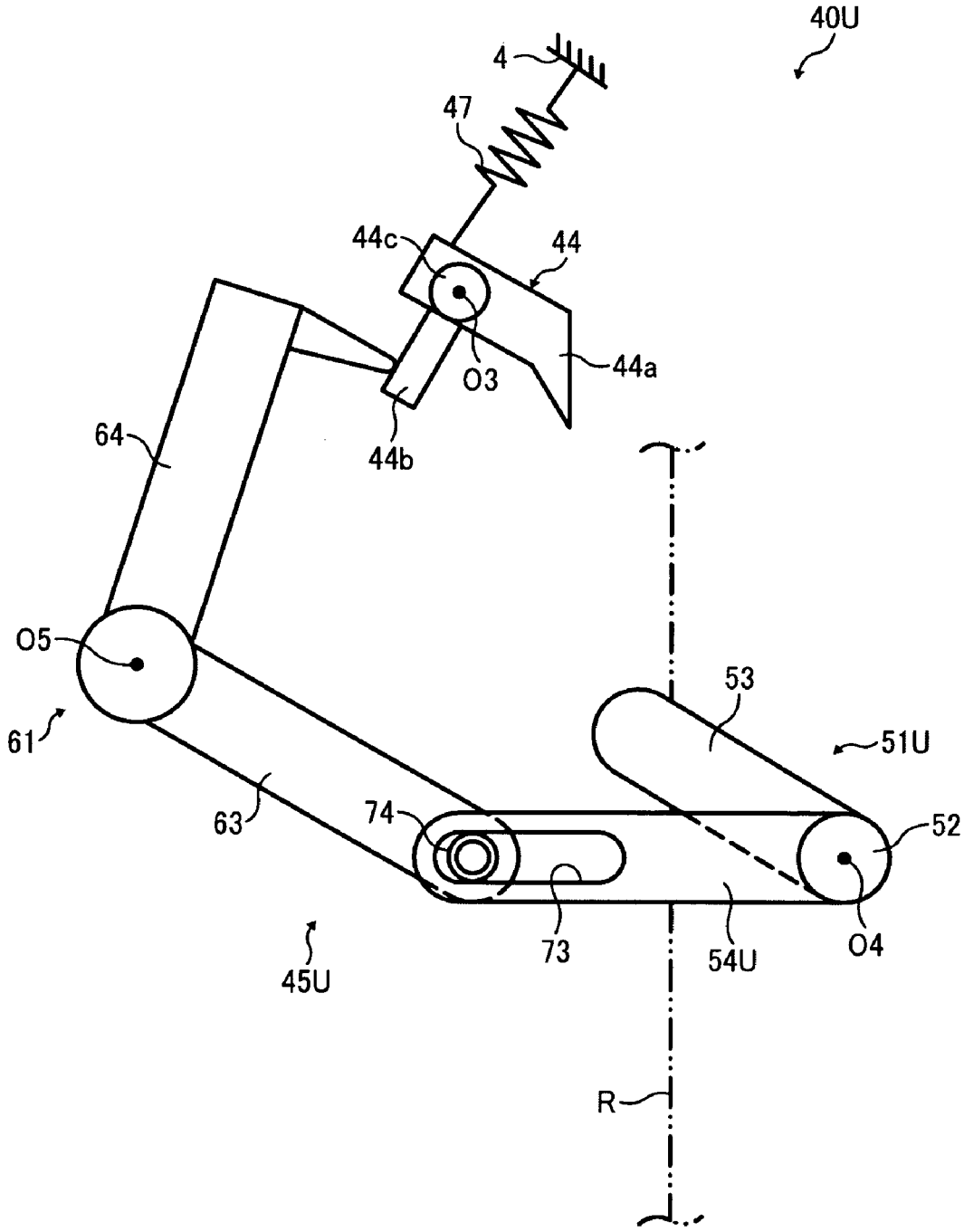
FIG. 11 is an axial end view of a fixing device according to yet another example embodiment.

Referring to FIG. 11, the following describes a fixing device 40U. FIG. 11 is an axial end view of the fixing device 40U. As illustrated in FIG. 11, the fixing device 40U includes a control mechanism 45U. The control mechanism 45U includes a feeler 51U. The feeler 51U includes the rotary shaft 52, the contact portion 53, and a pressing portion 54U. The pressing portion 54U includes an elongate hole 73 and a pin 74. The control mechanism 45U replaces the control mechanism 45 depicted in FIG. 2. The other elements of the fixing device 40U are equivalent to the elements of the fixing device 40 depicted in FIG. 2.

In the fixing device 40 depicted in FIG. 2, the pressing portions 54 of the feeler 51 contact and slide over the contact pins 65 of the transmission assembly 61 to transmit a pushing force received by the feeler 51 from the recording medium P which pushes and lifts the feeler 51 from the feeler 51 to the transmission assembly 61, and the pressing portions 54 may separate from the contact pins 65. In order to provide similar functions, the fixing device 40U includes the elongate hole 73 and the pin 74. The elongate hole 73 is provided in one of the pressing portion 54U and the feeler contact portion 63. According to this example embodiment, the elongate hole 73 is provided in the pressing portion 54U of the feeler 51U serving as an input mechanism, and the pin 74 is provided on the feeler contact portion 63, so that the pin 74 is inserted into the elongate hole 73 to engage the elongate hole 73. Thus, the elongate hole 73 and the pin 74 serve as a linking mechanism for linking the feeler 51U with the transmission assembly 61 linked with the separator 44.

The elongate hole 73 and the pin 74 increase strength of the control mechanism 45U. Further, a weight of the feeler 51U is also used to return the feeler 51U to the standby position illustrated in FIG. 2 after the recording medium P passes through the fixing nip N.

Figure 12:
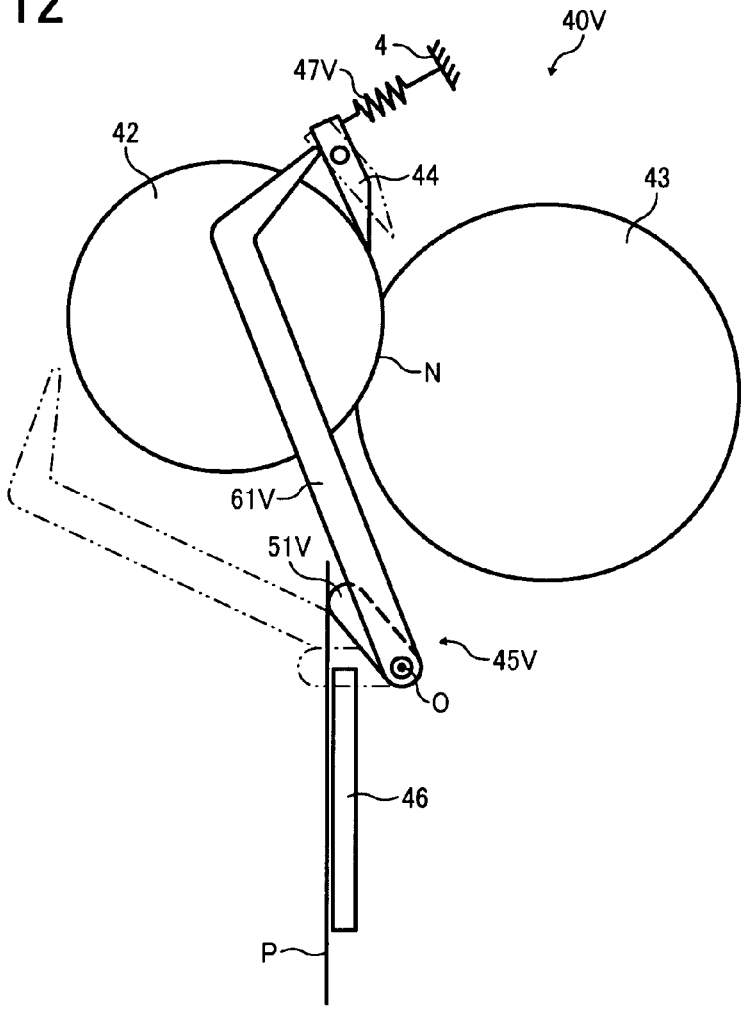
FIG. 12 is an axial end view of a fixing device according to yet another example embodiment.

Referring to FIG. 12, the following describes a fixing device 40V. FIG. 12 is an axial end view of the fixing device 40V. As illustrated in FIG. 12, the fixing device 40V includes a control mechanism 45V and a biasing member 47V. The control mechanism 45V includes a feeler 51V and a transmission assembly 61V. The control mechanism 45V and the biasing member 47V replace the control mechanism 45 and the biasing member 47 depicted in FIG. 2, respectively. The other elements of the fixing device 40V are equivalent to the elements of the fixing device 40 depicted in FIG. 2.

In the fixing device 40 depicted in FIG. 2, the biasing member 47 applies a biasing force to the separator 44 to cause the separator 44 to contact the fixing roller 42. By contrast, in the fixing device 40V depicted in FIG. 12, the biasing member 47V applies a biasing force to the separator 44 to cause the separator 44 to separate from the fixing roller 42. For example, the biasing member 47V may be a compressed biasing member as illustrated in FIG. 12. The feeler 51V, serving as an input mechanism, is combined with the transmission assembly 61V. The feeler 51V and the transmission assembly 61V are supported in such a manner that the feeler 51V and the transmission assembly 61V are rotatable about a rotation axis O.

Figure 13:
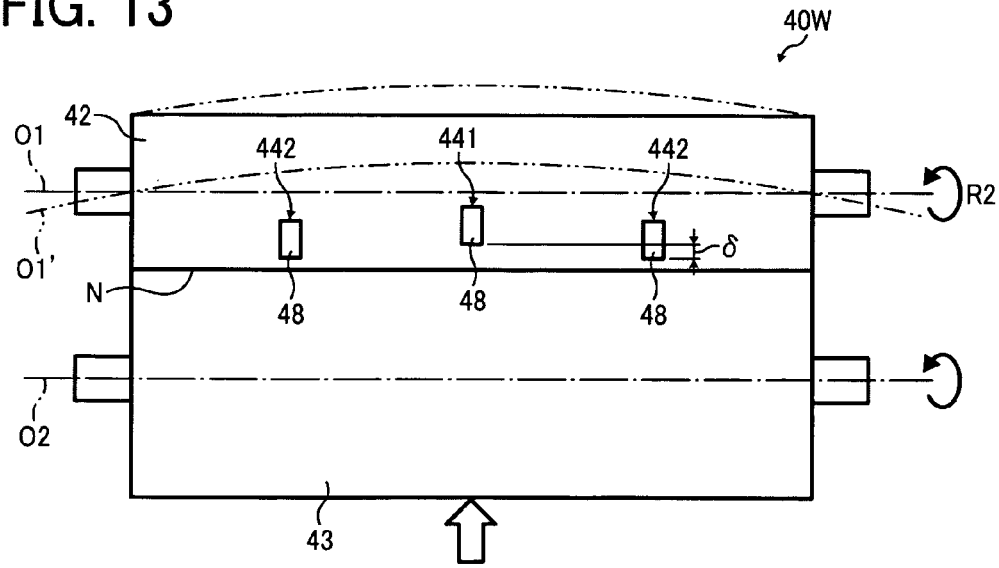
FIG. 13 is a plane view of a fixing device according to yet another example embodiment.

Referring to FIG. 13, the following describes a fixing device 40W. FIG. 13 is a plane view of the fixing device 40W. As illustrated in FIG. 13, the fixing device 40W includes a first separator 441 and second separators 442 replacing the separator 44 depicted in FIG. 2. The other elements of the fixing device 40W are equivalent to the elements of the fixing device 40 depicted in FIG. 2.

The fixing device 40W depicted in FIG. 13 may include at least three separators provided in a direction of the rotation axis O1 of the fixing roller 42 (e.g., the axial direction of the fixing roller 42). For example, three separators, which are the first separator 441 and the second separators 442, may be provided adjacent to each other at three positions in the direction of the rotation axis O1 of the fixing roller 42, respectively. The first separator 441 is provided at a center position in the direction of the rotation axis O1 of the fixing roller 42, and contacts the fixing roller 42. The second separators 442 are provided adjacent to the first separator 441 in such a manner that the second separators 442 sandwich the first separator 441 in the direction of the rotation axis O1 of the fixing roller 42. The first separator 441 contacts the fixing roller 42 at a first contact position provided by a distance δ downstream from second contact positions at which the second separators 442 contact the fixing roller 42 in the rotation direction R2 of the fixing roller 42.

When the fixing roller 42 contacting the pressing roller 43 is pressed and bent by the pressing roller 43, that is, when the rotation axis O1 is bent into a rotation axis O1', the first contact position of the first separator 441 at which the first separator 441 contacts the fixing roller 42 and the second contact positions of the second separators 442 at which the second separators 442 contact the fixing roller 42 are aligned to separate the recording medium P adhered to the fixing roller 42 from the fixing roller 42 smoothly.

As described above, in a fixing device (e.g., the fixing device 40, 40T, 40U, 40V, or 40W depicted in FIG. 2, 10, 11, 12, or 13, respectively), a fixing rotary member (e.g., the fixing roller 42 depicted in FIG. 2) includes a heat source (e.g., the heat source 41 depicted in FIG. 2). A pressing rotary member (e.g., the pressing roller 43 depicted in FIG. 2) contacts the fixing rotary member to form a fixing nip (e.g., the fixing nip N depicted in FIG. 2) between the fixing rotary member and the pressing rotary member through which a recording medium bearing a toner image passes. At least one first separator (e.g., the separator 44 or 44' depicted in FIG. 2 or 8, respectively, or the first separator 441 and the second separators 442 depicted in FIG. 13) is provided downstream from the fixing nip in a recording medium conveyance direction, and contacts the fixing rotary member to separate the recording medium, which has passed through the fixing nip, from the fixing rotary member. Thus, the fixing rotary member and the pressing rotary member apply heat and pressure to the recording medium bearing the toner image to fix the toner image on the recording medium.

A feeler (e.g., the feeler 51, 51S, 51U, or 51V depicted in FIG. 2, 9, 11, or 12, respectively) is provided upstream from the fixing nip in the recording medium conveyance direction and is contacted by a leading edge of the recording medium conveyed on a conveyance path (e.g., the conveyance path R depicted in FIG. 2) toward the fixing nip to receive a pushing force from the recording medium. A transmission assembly (e.g., the transmission assembly 61 or 61V depicted in FIG. 2 or 12, respectively) is connected to the feeler and the separator to receive and transmit the pushing force received by the feeler from the recording medium to the separator. Thus, the transmission assembly moves the separator from an at-rest non-contact position at which the separator does not contact the fixing rotary member to an in-operation contact position at which the separator contacts the fixing rotary member.

Accordingly, the pushing force received by the feeler from the recording medium contacting the feeler is mechanically transmitted to the separator via the transmission assembly. Consequently, the transmission assembly moves the separator from the non-contact position to the contact position precisely.

The fixing device may further include a biasing member (e.g., the biasing member 47 or 47V depicted in FIG. 2 or 12, respectively) attached to the separator. The biasing member may apply a first biasing force to the separator to cause the separator to contact the fixing rotary member.

Accordingly, the separator is biased toward the fixing rotary member, and therefore the separator contacts the fixing rotary member stably.

The transmission assembly may apply a pressing force to the separator to separate the separator from the fixing rotary member against the first biasing force applied by the biasing member. Accordingly, with a simple operation of releasing the pressing force applied by the transmission assembly to the separator, the first biasing force applied by the biasing member causes the separator to contact the fixing rotary member.

The separator may include a separator rotary shaft (e.g., the rotary shaft 44*c* depicted in FIG. 2) for rotatably supporting the separator, a body (e.g., the body 44*a* depicted in FIG. 2) mounted on the separator rotary shaft to contact the fixing rotary member, and a pressure reception portion (e.g., the pressure reception portion 44*b* depicted in FIG. 2) mounted on the separator rotary shaft to contact the transmission assembly to receive the pressing force applied by the transmission assembly. The pressure reception portion may extend in a direction intersecting a line (e.g., the line I depicted in FIG. 2) connecting a rotation axis (e.g., the rotation axis O3 depicted in FIG. 2) of the separator rotary shaft to a front edge portion (e.g., the front edge portion 48 depicted in FIG. 2) of the body contacting the fixing rotary member. Thus, the transmission assembly presses against the pressure reception portion of the separator.

Generally, a substantial space may not be provided near the separator. Accordingly, when the transmission assembly presses against the separator, the transmission assembly may apply a pressing force in a direction substantially parallel to a surface of the separator, resulting in decreased transmission efficiency for transmitting the pressing force from the transmission assembly to the separator. To address this problem, according to the above-described example embodiments, the transmission assembly applies the pressing force in a direction substantially perpendicular to the surface of the separator in a suppressed space, resulting in improved transmission efficiency for transmitting the pressing force from the transmission assembly to the separator. Further, the transmission assembly maintains or returns the separator at or to the non-contact position at which the separator does not contact the fixing rotary member precisely.

After the leading edge of the recording medium initially contacts the feeler, the feeler may move to a first compartment in the interior of the fixing device defined by the conveyance path and the pressing rotary member, and may contact one side of the recording medium.

Before the recording medium enters the fixing nip, the recording medium bears an unfixed toner image on an image side of the recording medium facing the fixing rotary member. Therefore, if the feeler contacts the image side of the recording medium, the feeler may degrade the unfixed toner image on the image side of the recording medium. To address this problem, according to the above-described example embodiments, the feeler contacts a non-image side of the recording medium which does not bear the unfixed toner image or bears a fixed toner image for duplex printing.

The feeler may include a feeler rotary shaft (e.g., the rotary shaft 52 depicted in FIG. 2) for rotatably supporting the feeler. A rotation axis (e.g., the rotation axis O4 depicted in FIG. 2) of the feeler rotary shaft of the feeler may extend parallel to a rotation axis (e.g., the rotation axis O1 depicted in FIG. 2) of the fixing rotary member.

The rotation axis of the feeler rotary shaft of the feeler may be provided in the first compartment of the fixing device defined by the conveyance path and the pressing rotary member. Accordingly, after the feeler is contacted and rotated by the recording medium, the recording medium contacts the feeler in the first compartment of the fixing device defined by the conveyance path and the pressing rotary member. Consequently, the feeler contacts the non-image side of the recording medium which does not bear the unfixed toner image.

The feeler rotary shaft of the feeler may include two ends extending in an axial direction of the feeler rotary shaft, which protrude beyond both side edges of the recording medium conveyed on the conveyance path, respectively, in the axial direction of the feeler rotary shaft. The transmission assembly may be connected to at least one of the two ends of the feeler rotary shaft of the feeler.

Accordingly, connected portions of the feeler provided in both ends of the feeler rotary shaft of the feeler in the axial direction of the feeler rotary shaft which are connected to the transmission assembly do not interfere with movement of the recording medium. Consequently, the pushing force received by the feeler from the recording medium when the recording medium contacts the feeler is transmitted to the transmission assembly precisely.

The feeler may further include at least one contact portion (e.g., the contact portion 53 depicted in FIG. 4 or 9) protruding from the feeler rotary shaft of the feeler in a direction substantially perpendicular to the axial direction of the feeler rotary shaft to contact the recording medium conveyed on the conveyance path.

Accordingly, a substantial distance is provided between a contact edge surface of the contact portion of the feeler which contacts the recording medium and the rotation axis of the feeler rotary shaft of the feeler. Consequently, when the recording medium contacts the feeler, the feeler receives a substantial rotation torque to change a position of the separator precisely.

A plurality of contact portions may be provided at a plurality of positions in the axial direction of the feeler rotary shaft of the feeler, respectively.

Accordingly, a load applied to the recording medium when the recording medium contacts the plurality of contact portions of the feeler is dispersed to prevent or reduce creases and damages of the recording medium such as damages of a cut edge of the recording medium.

The feeler may further include a plurality of bearings (e.g., the bearings 56 depicted in FIG. 6) provided at a plurality of positions in the axial direction of the feeler rotary shaft of the feeler, respectively, to contact and support the feeler rotary shaft of the feeler. Thus, the feeler rotary shaft of the feeler may not be bent.

The transmission assembly may include a transmission rotary shaft (e.g., the rotary shaft 62 depicted in FIG. 2) for rotatably supporting the transmission assembly, a feeler contact portion (e.g., the feeler contact portion 63 depicted in FIG. 2) mounted on the transmission rotary shaft to contact the feeler, and a separator contact portion (e.g., the separator contact portion 64 depicted in FIG. 2) mounted on the transmission rotary shaft to contact the separator.

Accordingly, the pushing force applied by the recording medium to the feeler when the recording medium contacts the feeler is transmitted to the transmission assembly via the feeler contact portion of the transmission assembly as a rotation torque. The pushing force transmitted to the transmission assembly rotates the transmission assembly. Accordingly, the separator contact portion of the transmission assembly presses against the separator and transmits the pushing force to the separator.

A rotation axis (e.g., the rotation axis O5 depicted in FIG. 2) of the transmission rotary shaft of the transmission assembly may be provided in a second compartment of the interior of the fixing device defined by the conveyance path and the fixing rotary member.

The separator is pressed against an outer circumferential surface of the fixing rotary member in a direction counter to a rotation direction of the fixing rotary member at an exit of the fixing nip in the recording medium conveyance direction. Therefore, the separator is provided in the second compartment of the fixing device defined by the fixing nip and the fixing rotary member. If the rotation axis of the transmission assembly is provided in the first compartment of the fixing device defined by the conveyance path and the pressing rotary member to cause the transmission assembly to contact the separator, the transmission assembly straddles the exit of the fixing nip, and therefore the recording medium is not discharged from the fixing nip easily. To address this problem, according to the above-described example embodiments, the rotation axis of the transmission assembly is provided in the second compartment of the fixing device defined by the conveyance path and the fixing rotary member. Thus, the transmission assembly does not straddle the exit of the fixing nip.

A weight of the transmission assembly may supply the transmission assembly with a second biasing force to cause the feeler contact portion of the transmission assembly to contact the feeler and to cause the separator contact portion of the transmission assembly to contact the separator constantly.

If a gap is provided between the feeler and the feeler contact portion of the transmission assembly or between the separator contact portion of the transmission assembly and the separator, the pushing force received by the feeler from the recording medium is transmitted through the gaps, resulting in delay of transmission of the pushing force. To address this problem, according to the above-described example embodiments, the pushing force received by the feeler from the recording medium is transmitted from the feeler to the feeler contact portion of the transmission assembly and further from the separator contact portion of the transmission assembly to the separator directly without time lag. Thus, the separator moves from the non-contact position at which the separator does not contact the fixing rotary member to the contact position at which the separator contacts the fixing rotary member quickly.

The feeler contact portion and the separator contact portion of the transmission assembly may be provided in the second compartment of the fixing device in an area defined by the rotation axis of the transmission rotary shaft of the transmission assembly and the conveyance path in a direction perpendicular to the recording medium conveyance direction.

Accordingly, the weight of the transmission assembly rotates the transmission assembly in a given rotation direction. The feeler is provided at a position upstream from the feeler contact portion of the transmission assembly and the separator is provided at a position upstream from the separator contact portion of the transmission assembly in the given rotation direction of the transmission assembly. Thus, rotation of the transmission assembly caused by the weight of the transmission assembly maintains the feeler to contact the feeler contact portion of the transmission assembly and maintains the separator contact portion of the transmission assembly to contact the separator. Namely, the weight of the transmission assembly rotates the transmission assembly in the given rotation direction without extra parts added to the fixing device.

The fixing device may further include a restriction member (e.g., the restriction member 71 depicted in FIG. 2) disposed near the transmission assembly to engage the transmission assembly rotated by the pushing force received from the feeler and restrict further rotation of the transmission assembly.

The restriction member restricts a position of the transmission assembly when the transmission assembly moves the separator to the contact position at which the separator contacts the fixing rotary member. An excessive contact pressure may not be applied from the separator to the outer circumferential surface of the fixing rotary member.

At least three separators including a first separator (e.g., the first separator 441 depicted in FIG. 13) and second separators (e.g., the second separators 442 depicted in FIG. 13) may be provided in an axial direction of the fixing rotary member. The first separator may be provided at a center position in the axial direction of the fixing rotary member. The second separators may be provided adjacent to the first separator in such a manner that the second separators sandwich the first separator in the axial direction of the fixing rotary member. A first contact position of the first separator at which the first separator contacts the fixing rotary member may be provided downstream from second contact positions of the second separators at which the second separators contact the fixing rotary member, respectively, in the rotation direction of the fixing rotary member.

Accordingly, when the fixing rotary member contacting the pressing rotary member is pressed and bent by the pressing rotary member, the first contact position of the first separator at which the first separator contacts the fixing rotary member and the second contact positions of the second separators at which the second separators contact the fixing rotary member are aligned to separate the recording medium adhered to the fixing rotary member from the fixing rotary member smoothly.

The fixing device according to the above-described example embodiments may be installed in an image forming apparatus (e.g., the image forming apparatus 12 depicted in FIG. 1) in which developer is supplied to an electrostatic latent image formed by exposing a uniformly charged surface of an image carrier (e.g., the photoconductor 1 depicted in FIG. 1) to make the electrostatic latent image visible as a toner image, the toner image is transferred and fixed onto a recording medium, and the recording medium bearing the toner image is discharged to an outside of the image forming apparatus.

According to the above-described example embodiments, the pushing force received by the feeler from the recording medium when the recording medium contacts the feeler is mechanically transmitted to the separator via the transmission assembly. The pushing force transmitted to the separator causes the separator to contact the fixing rotary member. Accordingly, the compact fixing device may be manufactured at reduced costs compared to a fixing device using an electromagnetic transmission device such as a sensor and a solenoid. Further, disturbance may not adversely affect control for switching the position of the separator, improving stability of the control.

The feeler provided upstream from the fixing nip in the recording medium conveyance direction detects the recording medium before the recording medium reaches the fixing nip. Movement of the separator may be controlled easily in such a manner that the separator separates from the fixing rotary member normally and the separator contacts the fixing rotary member immediately before the recording medium enters the fixing nip. Thus, an accumulated separation time when the separator separates from the fixing rotary member may be increased to suppress wear of the fixing rotary member and increase life of the fixing rotary member.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope, of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing rotary member;

a pressing rotary member to contact the fixing rotary member to form a fixing nip between the fixing rotary member and the pressing rotary member through which a recording medium bearing a toner image passes;

at least one first separator provided downstream from the fixing nip in a recording medium conveyance direction to contact the fixing rotary member to separate the recording medium having passed between the fixing rotary member and the pressing rotary Member from the fixing rotary member;

a feeler provided upstream from the fixing nip in the recording medium conveyance direction and contacted by a leading edge of the recording medium conveyed on a conveyance path toward the fixing nip to receive a pushing force from the recording medium; and a transmission assembly connected between the feeler and the separator to receive and transmit the pushing force received by the feeler from the recording medium to the separator to move the separator from a non-contact position at which the separator does not contact the fixing rotary member to a contact position at which the separator contacts the fixing rotary member.

2. The fixing device according to claim 1, further comprising a biasing member attached to the separator to apply a first biasing force to the separator to cause the separator to contact the fixing rotary member.

3. The fixing device according to claim 2, wherein the transmission assembly applies a pressing force to the separator to separate the separator from the fixing rotary member against the first biasing force applied by the biasing member.

4. The fixing device according to claim 3, wherein the separator comprises:

a separator rotary shaft to rotatably support the separator;

a body mounted on the separator rotary shaft to contact the fixing rotary member; and a pressure reception portion mounted on the separator rotary shaft to contact the transmission assembly to receive the pressing force applied by the transmission assembly, and wherein the pressure reception portion extends in a direction intersecting a line connecting a rotation axis of the separator rotary shaft to a front edge portion of the body contacting the fixing rotary member.

5. The fixing device according to claim 1, wherein the conveyance path and the pressing rotary member define a first compartment in the interior of the fixing device and the conveyance path and the fixing rotary member define a second compartment in the interior of the fixing device opposite the first compartment, and wherein, after the leading edge of the recording medium initially contacts the feeler, the feeler moves to the first compartment and contacts one side of the recording medium.

6. The fixing device according to claim 1, wherein the feeler comprises a feeler rotary shaft to rotatably support the feeler, and wherein a rotation axis of the feeler rotary shaft of the feeler extends parallel to a rotation axis of the fixing rotary member.

7. The fixing device according to claim 6, wherein the rotation axis of the feeler rotary shaft of the feeler is provided in the first compartment defined by the conveyance path and the pressing rotary member.

8. The fixing device according to claim 6, wherein the feeler rotary shaft includes two ends extending in an axial direction of the feeler rotary shaft that protrude beyond both side edges of the recording medium conveyed on the conveyance path in the axial direction of the feeler rotary shaft, and wherein the transmission assembly is connected to at least one of the two ends of the feeler rotary shaft of the feeler.

9. The fixing device according to claim 6, wherein the feeler further comprises at least one contact portion protruding from the feeler rotary shaft of the feeler in a direction substantially perpendicular to an axial direction of the feeler rotary shaft to contact the recording medium conveyed on the conveyance path.

10. The fixing device according to claim 9, wherein a plurality of contact portions is provided at a plurality of positions in the axial direction of the feeler rotary shaft of the feeler, respectively.

11. The fixing device according to claim 6, wherein the feeler further comprises a plurality of bearings provided at a plurality of positions in an axial direction of the feeler rotary shaft of the feeler, respectively, to contact and support the feeler rotary shaft.

12. The fixing device according to claim 1, wherein the transmission assembly comprises:

a transmission rotary shaft to rotatably support the transmission assembly;

a feeler contact portion mounted on the transmission rotary shaft to contact the feeler; and a separator contact portion mounted on the transmission rotary shaft to contact the separator.

13. The fixing device according to claim 12, wherein a rotation axis of the transmission rotary shaft is provided in the second compartment of the fixing device defined by the conveyance path and the fixing rotary member.

14. The fixing device according to claim 13, wherein the weight of the transmission assembly supplies the transmission assembly with a second biasing force to cause the feeler contact portion of the transmission assembly to contact the feeler and cause the separator contact portion of the transmission assembly to contact the separator constantly.

15. The fixing device according to claim 14, wherein the feeler contact portion and the separator contact portion of the transmission assembly are provided in the second compartment of the fixing device in an area defined by the rotation axis of the transmission rotary shaft and the conveyance path in a direction perpendicular to the recording medium conveyance direction.

16. The fixing device according to claim 13, further comprising a restriction member disposed near the transmission assembly to engage the transmission assembly rotated by the pushing force received from the feeler and restrict further rotation of the transmission assembly.

17. The fixing device according to claim 1, further comprising at least two second separators provided in an axial direction of the fixing rotary member, wherein the first separator is provided at a center position in the axial direction of the fixing rotary member, and the two second separators are provided adjacent to the first separator in such a manner that the second separators sandwich the first separator in the axial direction of the fixing rotary member, and wherein a first contact position of the first separator at which the first separator contacts the fixing rotary member is provided downstream from second contact positions of the second separators at which the second separators contact the fixing rotary member in a rotation direction of the fixing rotary member.

18. An image forming apparatus for forming a toner image on a recording medium, the image forming apparatus comprising:

a fixing device including:

a fixing rotary member;

a pressing rotary member to contact the fixing rotary member to form a fixing nip between the fixing rotary member and the pressing rotary member through which the recording medium bearing the toner image passes;

at least one first separator provided downstream from the fixing nip in a recording medium conveyance direction to contact the fixing rotary member to separate the recording medium having passed between the fixing rotary member and the pressing rotary member from the fixing rotary member;

a feeler provided upstream from the fixing nip in the recording medium conveyance direction and contacted by a leading edge of the recording medium conveyed on a conveyance path toward the fixing nip to receive a pushing force from the recording medium; and a transmission assembly connected between the feeler and the separator to receive and transmit the pushing force received by the feeler from the recording medium to the separator to move the separator from a non-contact position at which the separator does not contact the fixing rotary member to a contact position at which the separator contacts the fixing rotary member.

* * * * *